United States Patent [19]

Hon

[11] Patent Number: 4,787,298

[45] Date of Patent: Nov. 29, 1988

[54] METHOD AND APPARATUS TO CONSOLIDATE ROOM AND POINT EXHAUST WITH A SINGLE FAN

[75] Inventor: Clarence C. Hon, Cherry Hill, N.J.

[73] Assignee: Mobil Oil Corporation, New York, N.Y.

[21] Appl. No.: 99,852

[22] Filed: Sep. 22, 1987

[51] Int. Cl.[4] ..... F23J 11/00

[52] U.S. Cl. ..... 98/115.4; 98/115.1

[58] Field of Search ..... 98/42.06, 115.1, 115.4

[56] References Cited

U.S. PATENT DOCUMENTS

| | | | |
|---|---|---|---|
| 536,097 | 3/1895 | Reading | 98/115.1 |
| 1,048,477 | 12/1912 | Allington | 98/115.4 X |
| 1,734,449 | 11/1929 | Smith | 98/115.1 X |
| 2,162,019 | 6/1939 | Johnson | 98/115.4 |
| 2,347,334 | 4/1944 | Schmieg | 98/115.4 |
| 2,422,330 | 6/1947 | Allerdice | 98/115.1 X |
| 2,436,508 | 2/1948 | Fairbanks | 98/115.4 |
| 2,604,840 | 7/1952 | Loosli et al. | 98/115.4 |
| 2,733,668 | 2/1956 | Pfetzing | 98/115.4 X |
| 3,200,765 | 8/1965 | Amblie | 98/115.4 X |
| 3,368,474 | 2/1968 | Sklar | 98/115.4 |
| 3,453,369 | 7/1969 | Dock | 98/115.4 X |
| 3,473,462 | 10/1969 | Imming | 98/115.4 |
| 3,818,817 | 6/1974 | Nederman | 98/115.4 |
| 4,086,847 | 5/1978 | Overmyer | 98/115.4 |
| 4,446,861 | 5/1984 | Tada | 98/115.4 |

*Primary Examiner*—Harold Joyce

*Attorney, Agent, or Firm*—Alexander J. McKillop; Michael G. Gilman; Charles J. Speciale

[57] ABSTRACT

Ambient and localized sites within a room space are exhausted as required into a single fan unit and exhaust main. Flexible ducts connected to the main are positionable at various site locations and when one is used to for effecting exhaust at a site, the ambient exhaust to the main and the exhaust path of any other flexible duct is closed off so that exhaust flow in the system can enter only through the selected flexible duct thus maximizing the rapidity and facility with which undesirable gases present at the local site can be removed effectively and most economically from the room space.

5 Claims, 1 Drawing Sheet

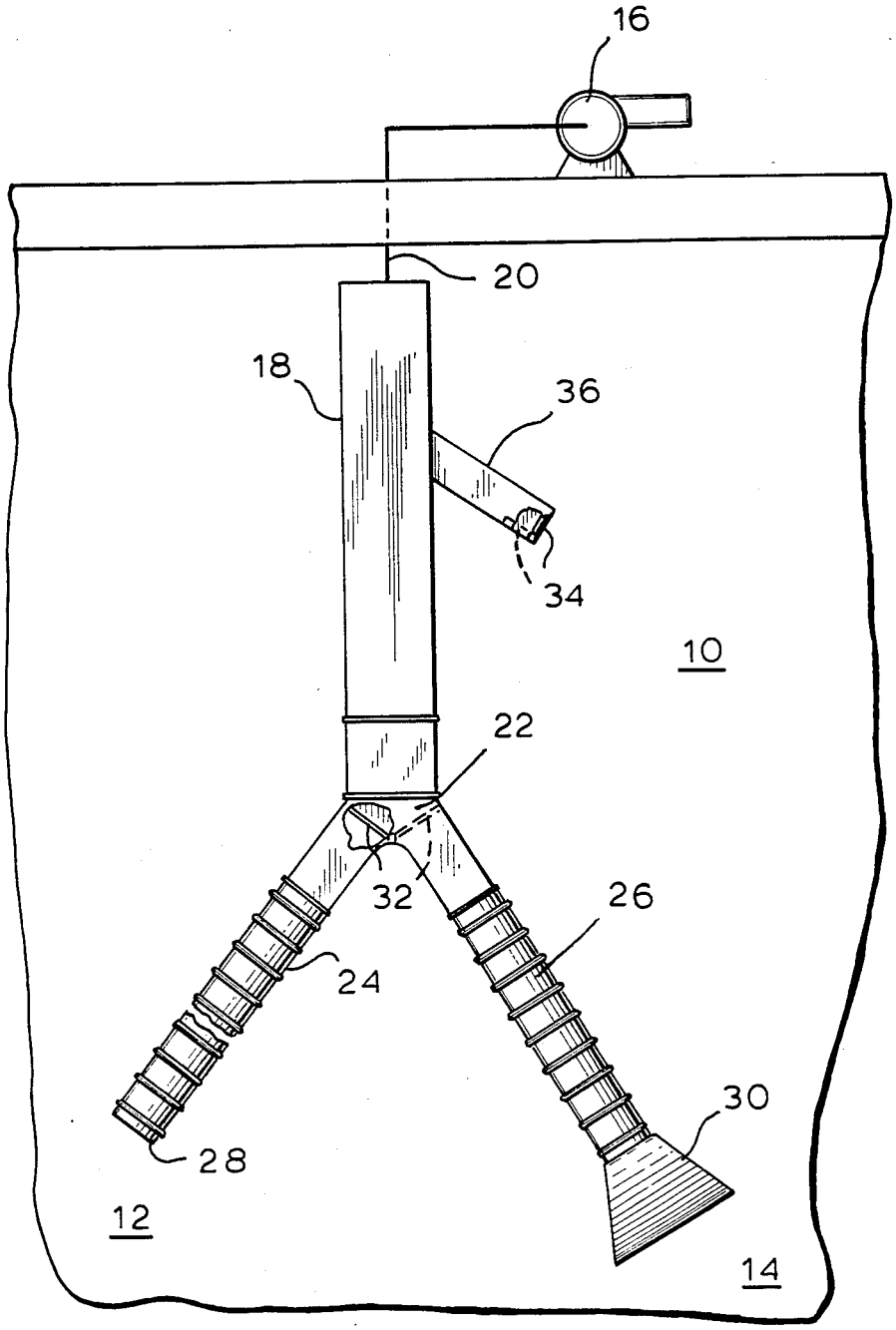
16
20
18
36
34
10
22
32
26
24
30
28
12
14

METHOD AND APPARATUS TO CONSOLIDATE ROOM AND POINT EXHAUST WITH A SINGLE FAN

BACKGROUND OF THE INVENTION

The present invention relates to the consolidation of normal ambient room ventilation exhaust with that of special point or work site location exhaust requirements so that exhaust operations conveniently can be handled with a single fan unit rather than with two separate fans associated each with a specific one of such requirements.

Many commercial and/or industrial operations are carried out in work spaces which present the dual requirement of maintaining a continuous circulating inflow and out-flow of ventilation or ambient air to the space (air change cycle) as well as capability for effecting rapid exhausting of gases liberated at a local work site in the space and evolving incident a particular industrial operation. These evolved gases can be of wide description as to type inclusive of simply being heated air or water vapor, or they may be industrial operation by-products which may constitute air pollutants and/or contaminants, etc. Effective removal of these gases directly at the site is desirable both from the standpoint of worker comfort and reduced exposure to pollutants. Patents which disclose aspects of point exhaust in a room space at plural locations and with one or more movable or flexible exhaust ducts is disclosed, for example, in U.S. Pat. Nos. 2,162,019; 2,347,334; 2,436,508; 2,604,840; 2,733,668; 3,368,474; 3,473,462; 4,086,847 and 4,446,861.

It has been commonplace in the past to meet the dual need of exhausting a room space and a localized work site by use of two separate exhausting arrangements. Thus, a first fan and associated duct work has been employed to remove space ambient air as part of the regular air change operation. Exhaust from a given work site on the other hand has been effected with a second duct arrangement and exhaust fan. In meeting the air change cycle needs, the ambient exhaust fan unit will operate on a continuous basis while the work site exhaust fan will operate on an intermittent basis, although, in some circumstances it too may be operated continuously. The situations where a particular gas is liberated at a work site may occur only at spaced time intervals. Thus operation of the gas removal fan unit on a continuous basis is wasteful of energy and adds unnecessary wear to the fan and its component parts. It is desirable therefore that a more effective, economical and simpler manner and apparatus arrangement be provided for exhausting a room space environment as well as when required, localized areas at work sites within the room space. Such exhaust arrangement also should effectuate rapid point exhaust with employment of speeded-up gas removal obtained with higher fan speed than that required for normal air change cycle purposes.

SUMMARY OF THE INVENTION

The present invention provides for maintaining with a single exhaust fan and arrangement of duct work, normal air change cycling of atmospheric air in a room space such as in a chemical or manufacturing operating space, and also the removal at a particular work site within that space of any undesirable or unwanted gases which may evolve from or be liberated during a particular manufacturing and/or chemical activity.

An exhaust fan, such as a multi-speed exhaust fan is located remote from the room space, e.g., being mounted on the roof above the room. An exhaust main suitably elongated to give reach to the various parts of ambient environment expanse is disposed within the room space and at a certain location thereon has an inlet through which the ambient space communicates with the interior of the exhaust main. The exhaust main has an end connected directly to the exhaust fan by a suitable exhaust main extension piece.

Inlet blocking means such as a damper movable between fully closed and fully opened positions is mounted at the exhaust main inlet. Normally the blocking means will be in open position associated with the normal and continuous exhausting of the ambient air from the room space as part of the air change cycle.

Disposed at the other end of the exhaust main and connected thereto with a suitable transition member are two separate flexible exhaust ducts, these flexible exhaust ducts being designed to be readily movably manipulated to various work site locations within the room space so that together the two flexible exhaust ducts are capable of reaching or accessing all possible work site locations in the room space.

A damper also is mounted in the transition member and can be moved selectively to one or the other of two positions in which that damper blocks communication of one or the other of the two flexible exhaust ducts with the exhaust main. The flexible exhaust ducts have suction or point pickup ends which are used by positioning them at a given work site to effect intake of gases liberated at such work site to the flexible exhaust duct and thence through the exhaust main and exhaust fan to an extra room space environment, i.e., atmosphere or a gas treatment operation.

In accordance with the invention when it is desired or necessary to effect local work site exhaust, the damper at the inlet to the exhaust main will be moved to inlet blocking position and the damper in the transition piece will be moved to block off communication of the flexible exhaust duct which is not being used at the work site with the exhaust main. Thus, exhaust flow through the exhaust main and exhaust fan will be of any air and gases which enter from the room space into the system only through the given flexible exhaust duct. During the time that this gas exhaust at the localized work site is being carried out, the exhaust fan desirably will be operated at a higher speed than that at which it is operated when only normal room exhaust is being carried.

After a desired or necessary local work site exhaust operation has been completed, the inlet opening in the exhaust main will be unblocked and the fan speed will be reduced to reestablish the normal room air exhaust operation cycle.

The invention accordingly comprises the features of construction, combination of elements, arrangement of parts and steps as will be exemplified in the exhaust apparatus and method of exhausting a room space and localized work site therein as will be exemplified in the description hereinafter set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawing in which the single figure thereof is a schematic depiction of the apparatus used for effecting normal room exhaust and localized work site exhaust with a single fan unit.

Throughout the following description, like reference numerals are used to denote like parts in the drawing.

DESCRIPTION OF THE PREFERRED EMBODIMENT

Referring to the drawing, the room space generally designated 10 can be any one of various kinds of enclosed spaces wherein manufacturing, chemical processing, and like types of operations are being conducted and which result in liberation of gases at localized sites within the room space which gases desirably and/or necessarily must be removed from the room space along with the normal ambient air. The work sites 12 and 14 can by way of example be locations in a room space wherein is situated a chemical reactor, these work sites constituting locations or areas at which reactor charging or discharging operations take place and in consequence of which liberation of gases from the reactor can occur. The invention is applicable to other types of gas evolving operations as well. Also the flexible exhaust ducts may be fitted with hoods in the case of free gas discharge or they may be connected in sealed manner to a collection vessel at the site wherein product is collected and during such collection gases are liberated.

An exhaust fan unit 16 is located outside the room space, for example, being located on a roof structure above the room space. Disposed within the room space is an exhaust main 18 having certain elongated character and being connected at one end as at 20 with the exhaust fan. Connected to the other end of the main 18 is a transition piece or y-section 22 from which extend a pair of flexible exhaust ducts 24, 26. These flexible exhaust ducts 24, 26 are of a type commonly used to effect exhaust at a particular work site and they include each a suction end as at 28 which in use is moved to disposition at the work site. As noted above, the suction end can be connected to a hood 30 overlaying a substantial expanse of the work site or if without a hood or the hood be removed, to a fitting (not shown) on an enclosed vessel from which is intended that gases contained therein be exhausted directly to the atmosphere without any leakage thereof into the room space. A two position damper 32 is fitted in the y-member 22 on the exhaust main and by appropriately positioning the same in one or the other of its two positions, it will block communication of one of the two flexible exhaust ducts with the exhaust main. Similarly a damper 34 is provided in an exhaust branch 36 which branch constitutes an inlet to the exhaust main 18 from the room space environment In operating the apparatus to effect normal room space exhaust or air change cycle, damper 34 is maintained in an open position and in consequence air will be withdrawn from the room air space in normal intended air change manner. Air also will be withdrawn through the particular flexible exhaust duct which is not blocked off from the exhaust main. However, when it is desired that the apparatus be employed for exhaust of gases evolved at a particular work site within the room space, a suitable one of the two flexible exhaust ducts, e.g., duct 24 will be manipulated to position it at the work site, the damper 32 will be positioned so as to block off communication of the other flexible exhaust duct 26 with the exhaust main 18, and damper 34 on exhaust main branch 36 also will be closed. In this manner the only exhaust that can be effected through the exhaust main will be that which enters through the suction end of flexible exhaust duct 24. Further, it is desirable that the exhaust fan 16 be provided as a multi-speed unit and operated at a lower speed under a normal room exhaust operation but be changed over to operate at higher speed when a point or local site exhaust is being made. In this manner maximized withdrawal of any undesirable gases can be effected and until the exhaust removal of such gases is completed at which point the system will be reoriented to the normal room exhaust mode.

While there is above disclosed only one embodiment of the apparatus and method of the present invention, it would be appreciated that various modifications can be made thereto by those skilled in the art and yet remain within the scope of the inventive concept disclosed.

What is claimed is:

1. Apparatus for exhausting a room space and localized areas within said room space with a common exhaust fan, said apparatus comprising an exhaust fan located remote from the room space, an exhaust main disposed in the room space and communicating at one end thereof with the exhaust fan, a pair of flexible exhaust ducts connected with the other end of said exhaust main, each of said flexible exhaust ducts being movably positionable to locate a suction end thereof at selected localized areas within the room space, damper means at said other end of said exhaust main and selectively operable to block communication of one or the other of said flexible exhaust ducts with the exhaust main, and an exhaust main inlet communicating with the room space and located intermediate the ends of said exhaust main, said inlet including selectively operable inlet blocking means which in blocking condition blocks exhaust main inlet communication with the room space whereby during such condition exhaust flow in the main is only that which has entry to the main through one or the other of said flexible exhaust ducts, room space exhaust entering said exhaust main inlet when said blocking means is in unblocking condition.

2. The apparatus of claim 1 in which the exhaust main inlet is a branch duct, the inlet blocking means comprising a damper in said exhaust duct.

3. The apparatus of claim 1 in which the exhaust fan is a plural speed type.

4. Method for exhausting through a single multi-speed exhaust fan located outside the room space normal room space ambient air and any gases which may be liberated at localized work sites within said room space through a single multi-speed exhaust fan located outside the room space, said method comprising disposing an exhaust main having an ambient air inlet within the room space and communicating an end of said exhaust main with the exhaust fan, providing a pair of flexible exhaust ducts and connecting them with the other end of said exhaust main such that the suction end of each can be positioned at localized work sites in the room space, and blocking the ambient air inlet and the communication of one of said flexible exhaust ducts with the exhaust main whenever it is desired to exhaust gases present at a work site where the suction end of the other flexible exhaust duct has been positioned so that the only exhaust flow in the exhaust main is that drawn into the main through said other flexible exhaust duct.

5. The method of claim 4 in which the exhaust fan is operated during exhaust of gases from a work site at a higher speed than it is operated at when the ambient air inlet is unblocked.

* * * * *